US011035365B2

(12) United States Patent
Sinico et al.

(10) Patent No.: US 11,035,365 B2
(45) Date of Patent: Jun. 15, 2021

(54) CENTRIFUGAL ELECTRIC PUMP ASSEMBLY

(71) Applicant: DAB PUMPS S.P.A., Mestrino (IT)

(72) Inventors: Francesco Sinico, Montecchio Maggiore (IT); Pietro Cailotto, Trissino (IT); Enrico Trentin, Gambellara (IT); Michele Cappocchin, Mestrino (IT); Stefano Tazioli, Rosignano Marittimo (IT)

(73) Assignee: DAB PUMPS S.P.A., Mestrino (IT)

( * ) Notice: Subject to any disclaimer, the term of this patent is extended or adjusted under 35 U.S.C. 154(b) by 17 days.

(21) Appl. No.: 16/282,841

(22) Filed: Feb. 22, 2019

(65) Prior Publication Data

US 2019/0277293 A1 Sep. 12, 2019

(30) Foreign Application Priority Data

Mar. 9, 2018 (IT) ..... 102018000003390

(51) Int. Cl.
*F04D 13/06* (2006.01)
*F04D 29/08* (2006.01)
*F04D 29/02* (2006.01)

(52) U.S. Cl.
CPC ..... *F04D 13/06* (2013.01); *F04D 13/0686* (2013.01); *F04D 29/026* (2013.01); *F04D 29/086* (2013.01); *F05B 2240/57* (2013.01)

(58) Field of Classification Search
CPC .... F04D 13/0686; F04D 29/426; F04D 13/06; F04D 13/0626; F04D 29/628; F04D 13/0606; F04D 13/0693; F04D 29/026; F04D 29/605
See application file for complete search history.

(56) References Cited

U.S. PATENT DOCUMENTS 5,117,138 A * 5/1992 Than ..... H02K 5/08 310/89
5,644,178 A * 7/1997 Halm ..... H02K 3/50 310/43
5,701,388 A * 12/1997 Steinhardt ..... A61H 33/0095 392/471

(Continued)

FOREIGN PATENT DOCUMENTS

EP 1 947 347 A1 7/2008
EP 2500574 A1 9/2012

OTHER PUBLICATIONS

IT Search Report dated Nov. 5, 2018 re: Application No. IT 102018000003390, pp. 1-6, citing: EP 2 500 574 A1 and US 5 644 178 A.

(Continued)

*Primary Examiner* — Dominick L Plakkoottam
(74) *Attorney, Agent, or Firm* — Scully, Scott, Murphy & Presser, P.C.

(57) ABSTRACT

An electric pump assembly includes in sequence: a wet section, an air gap sleeve containing the rotor of an electric motor, and a casing which contains the stator of an electric motor. The electric pump assembly further includes a box, which contains an electronic board- and has a tubular body for the insertion of a plug for access to the wet section. The casing is substantially concentric to the air gap sleeve. The box is constituted by a tray which is closed hermetically by a lid.

14 Claims, 4 Drawing Sheets

(56) References Cited

U.S. PATENT DOCUMENTS

| | | | | |
|---|---|---|---|---|
| 8,721,306 | B2 * | 5/2014 | Andersen | H02K 5/225 417/423.14 |
| 2004/0160142 | A1 * | 8/2004 | Marioni | F04D 29/628 310/91 |
| 2013/0141387 | A1 * | 6/2013 | Royhob | H03K 17/9622 345/174 |
| 2013/0343935 | A1 * | 12/2013 | Hoj | H02K 7/14 417/423.7 |
| 2014/0050603 | A1 * | 2/2014 | Hoj | F04D 29/426 417/410.1 |
| 2014/0117032 | A1 * | 5/2014 | Tazioli | B65D 59/02 220/796 |
| 2016/0153469 | A1 * | 6/2016 | Mikkelsen | F04D 1/06 415/203 |
| 2018/0313365 | A1 * | 11/2018 | Salvi | F04D 29/605 |
| 2019/0066880 | A1 * | 2/2019 | Takada | H01R 43/20 |

OTHER PUBLICATIONS

European Examination Report dated Feb. 25, 2021 received in European Application No. 19 158 803.7.

* cited by examiner

CENTRIFUGAL ELECTRIC PUMP ASSEMBLY

CROSS-REFERENCE TO RELATED APPLICATIONS

This application is related to and claims the benefit of Italian Patent Application No. 102018000003390, filed on Mar. 9, 2018, the contents of which are herein incorporated by reference in their entirety.

TECHNICAL FIELD

The present disclosure relates to a centrifugal electric pump assembly. More particularly, the disclosure relates to a centrifugal pump assembly with improved seal. The disclosure is applicable in the field of electric circulating pumps for heating or conditioning systems.

BACKGROUND

Conventional centrifugal electric pump assemblies are composed substantially of a hollow body provided with intake and delivery ducts and containing one or more impellers interleaved by diffusers and keyed on the shaft of an electric motor which is enclosed in a motor casing that isolates it from the pumping liquid.

Centrifugal electric circulating pumps for home systems are normally driven and controlled by an electronic board.

Some of the causes of malfunction or failure problems of this type of electric pump are linked to the penetration of dust and/or liquids, generally water, in the box that contains the electronic board or the electric motor itself.

Dust and water are normally dangerous for the operation of the pump because they can compromise the electrical and mechanical functions of the electric pump.

SUMMARY

The aim of the present disclosure is to provide a centrifugal electric pump assembly that is capable of improving the background art in one or more of the aspects indicated above.

Within this aim, the disclosure provides a centrifugal electric pump assembly that ensures the maximum seal with respect to the penetration of dust and/or liquids.

The disclosure also provides a centrifugal electric pump assembly that prevents the penetration of water and/or dust in the electronic box and in the electric motor.

The disclosure also provides a centrifugal electric pump assembly that is highly reliable, relatively easy to provide and at competitive costs.

These advantages and others which will become better apparent hereinafter are achieved by providing an electric pump assembly comprising in sequence: a wet section, an air gap sleeve, which contains a rotor of an electric motor and a casing which contains a stator of an electric motor, and a box, which contains an electronic board and has a tubular body for the insertion of a plug for access to said wet section, said casing being substantially concentric to said air gap sleeve, characterized in that said box is constituted by a tray which is closed hermetically by a lid.

BRIEF DESCRIPTION OF THE DRAWINGS

Further characteristics and advantages of the disclosure will become better apparent from the description of a preferred but not exclusive embodiment of the electric pump assembly according to the disclosure, illustrated by way of non-limiting example in the accompanying drawings, wherein.

DETAILED DESCRIPTION OF THE DRAWINGS

Figure 1:
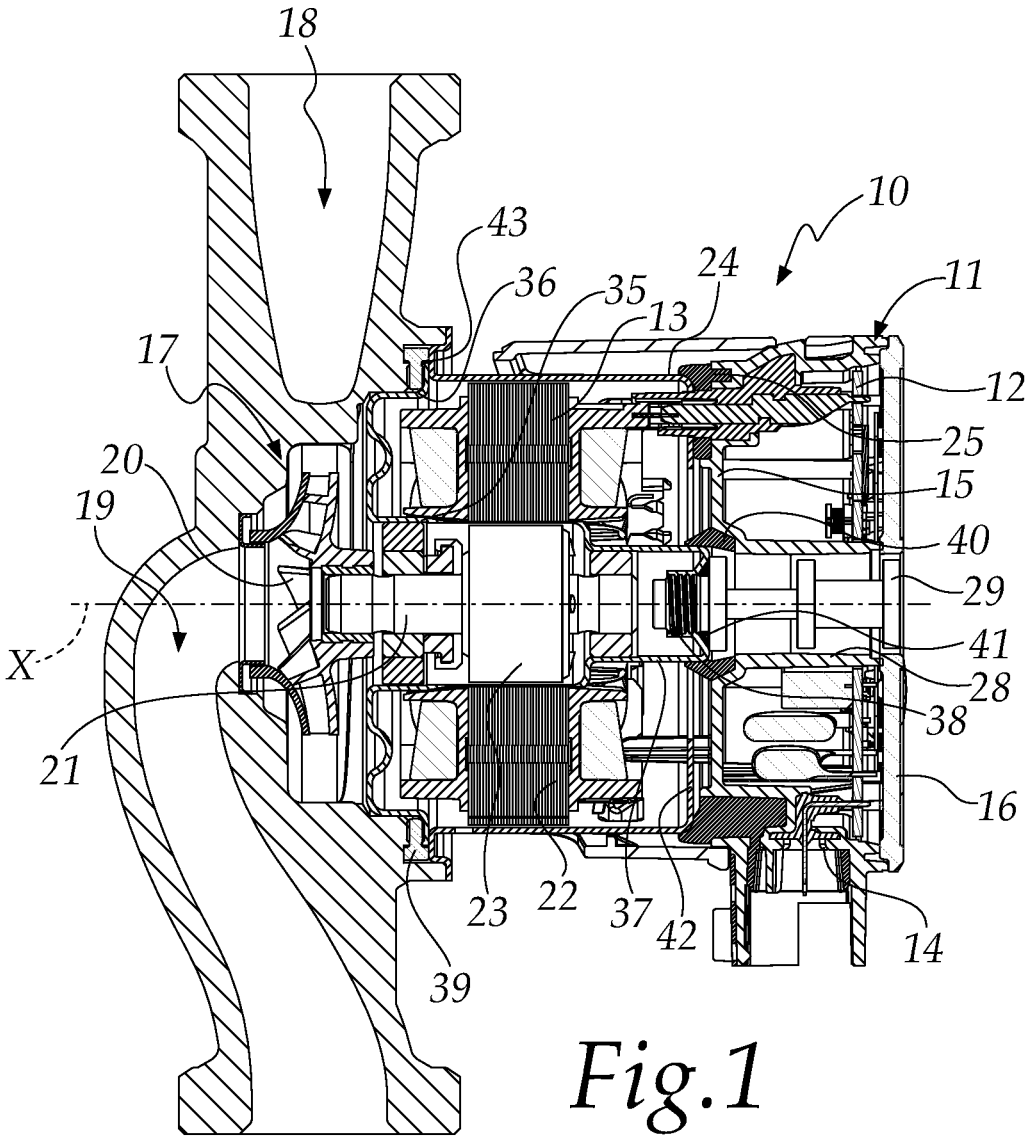
FIG. 1 is a sectional view of the electric pump assembly according to the disclosure in a first embodiment.

With reference to FIGS. 1-7, an electric pump assembly according to the disclosure is shown in cross-section in FIG. 1 and is designated by the reference numeral 10.

The centrifugal electric pump assembly 10 comprises, at one end, a box 11, which contains an electronic board 12 for regulating and supplying the electric motor 13.

A terminal 14 for the electric power supply of the electric pump extends from the electronic board 12.

The box 11 is made of plastic material and has a substantially cylindrical extension.

The box 11 comprises a through central tubular body 28 with an axis of extension X, which coincides with the axis of extension of the box 11.

The tubular body 28 is adapted for access to the wet section, on the part of the user, after removing a plug 29.

The box 11 is constituted by a tray-like base 15, which is closed hermetically by a lid 16.

The centrifugal electric pump assembly 10 comprises, at the other end, a wet section 17 provided with an intake duct 18 and a delivery duct 19, a volute, and an impeller 20, of a known type, which is immersed in said wet section.

The impeller 20 is keyed on a shaft 21 of the electric motor 13 composed of a stator 22 and a rotor 23 contained in an air gap sleeve 35.

A casing 24 for accommodating said stator 22 is interposed between the box 11 and the wet section 17 and is substantially concentric with respect to the air gap sleeve 35.

The casing 24 is made of stainless steel.

One of the particularities of the disclosure resides in that there is a first sealing element 25 between the casing 24 and the box 11.

The first sealing element 25 is made of plastic material and is co-molded with the box 11.

The air gap sleeve 35 has a first flanged end 36 which faces the wet section 17 and a second tubular end 37 which is opposite with respect to the first one, is connected to the box 11 and is provided with a threaded body 38 for the fastening of the plug 29 for access to the wet section.

The box 11 faces a first end 42 of the casing 24.

The casing 24 comprises a second end 43 which is opposite the first end 42 and faces partly the wet section 17 and partly the flanged first end 36 of the air gap sleeve 35.

A second sealing element 39, for example made of plastic material and having a T-shaped cross-section, is present between the flanged first end 36 of the air gap sleeve 35, the second end 43 of the casing 24 and the wet section 17.

A third sealing element 40, for example made of plastic material, is present between the second end 37 of the air gap sleeve 35, the first end 42 of the casing 24 and the box 11.

A fourth sealing element 41, such as for example an O-ring, is present between the second end 37 of the air gap sleeve 35 and the plug 29.

Figure 2:
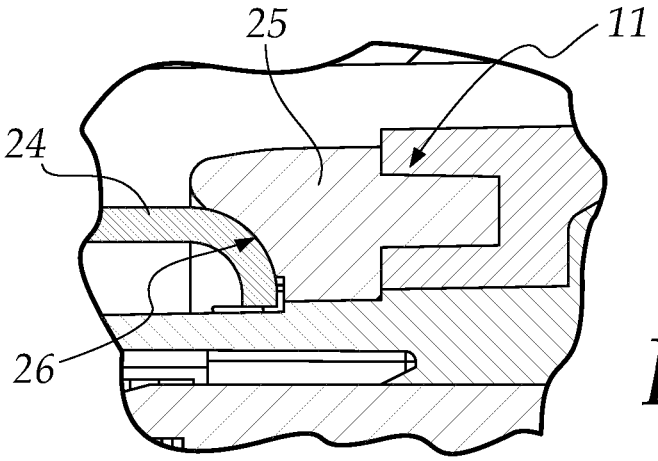
FIG. 2 is a sectional view of a detail of the electric pump assembly of FIG. 1.

FIG. 2 is an enlarged-scale view of a detail of the cross-section of FIG. 1.

In the region 26 of the casing 24, which corresponds to the region for interfacing with the first sealing element 25, there is a surface roughness, not shown in the figures, which is adapted to provide sufficient friction and adhesion with the first sealing element 25 and avoid the penetration of dust and/or water inside the motor.

Figure 3:
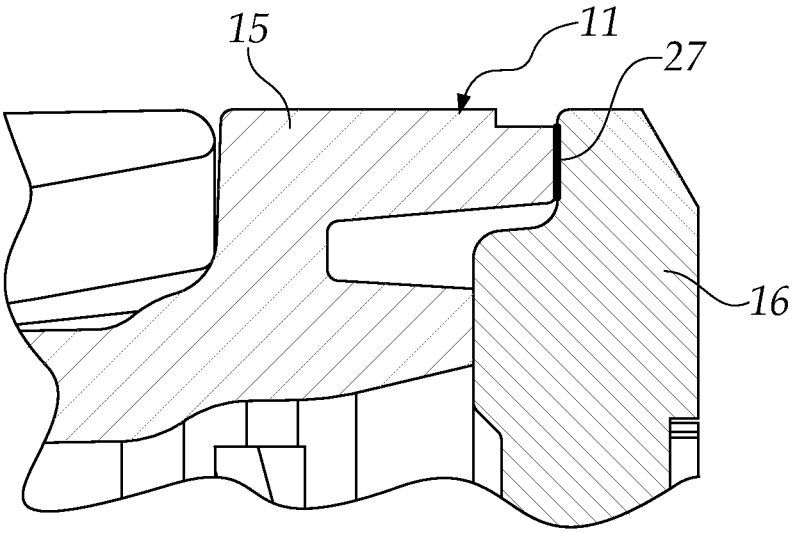
FIG. 3 is sectional view of another detail of the electric pump assembly of FIG. 1.

In particular, with reference to FIG. 3, the box 11 is closed hermetically, for example by means of a perimetric laser weld 27, along the circular edge of the box, in the region for interfacing between the tray 15 and the lid 16.

Figure 4:
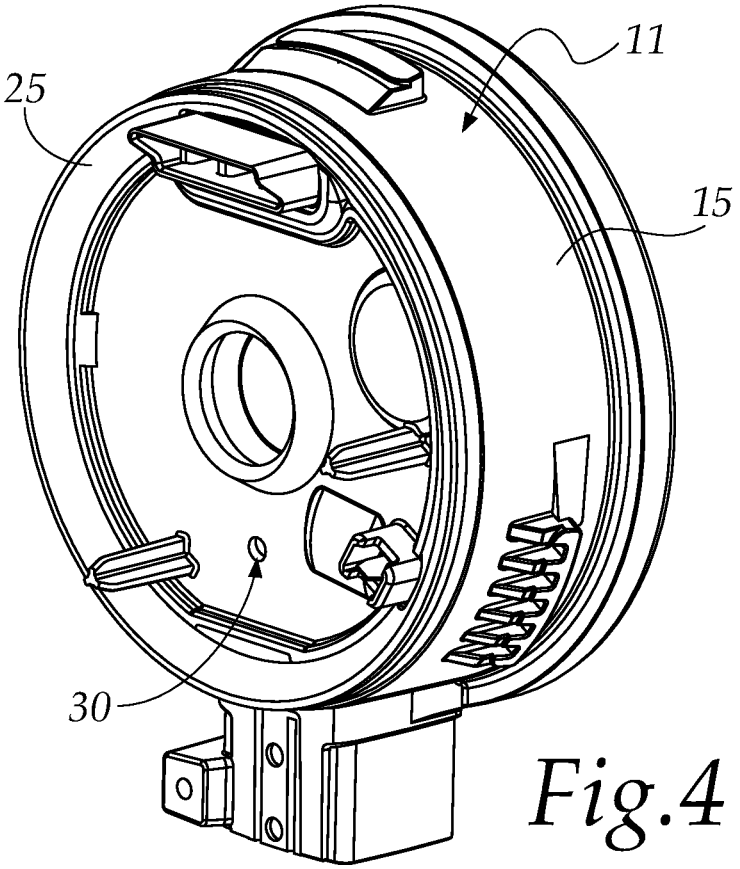
FIG. 4 is a general perspective view of an element of the electric pump assembly of FIG. 1.

With reference to FIG. 4, the box 11 is provided with at least one through hole 30.

The hole 30 is located on the surface of the box 11 that faces the casing 24, within the perimeter defined by the first sealing element 25.

The hole 30 has the purpose of connecting the box 11 to the casing 24, preventing the onset of overpressures inside the box 11, which might cause damage to the electronics and compromise the operation of the entire electric pump.

In a variation, not shown in the figures, the through hole might not be present.

Figure 5:
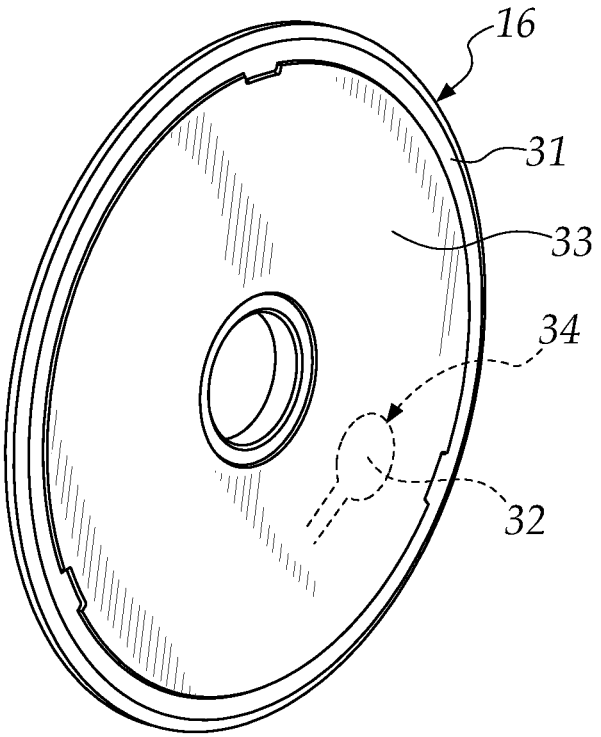
FIG. 5 is a general view of some components of the electric pump assembly of FIG. 1.

FIG. 5 is a general view of the lid 16 of the box 11.

On the lid 16 there is a portion 32 that is partially separated from the rest, by means of an opening region 34, which is adapted to form the surface of a button for interaction with the electronic board 12 contained inside the box 11.

An adhesive label 33 is applied to the surface 31 of the lid 16 that is opposite with respect to the surface arranged inside the box 11 and has at least such dimensions as to close the opening region 34 that is adjacent to the portion 32.

The portion 32 is therefore closed within the volume defined by the box 11 with the adhesive label 33 on the outer surface of the box.

In this manner, the adhesive prevents the penetration of dust or water into the box, at the opening region 34.

Figure 6:
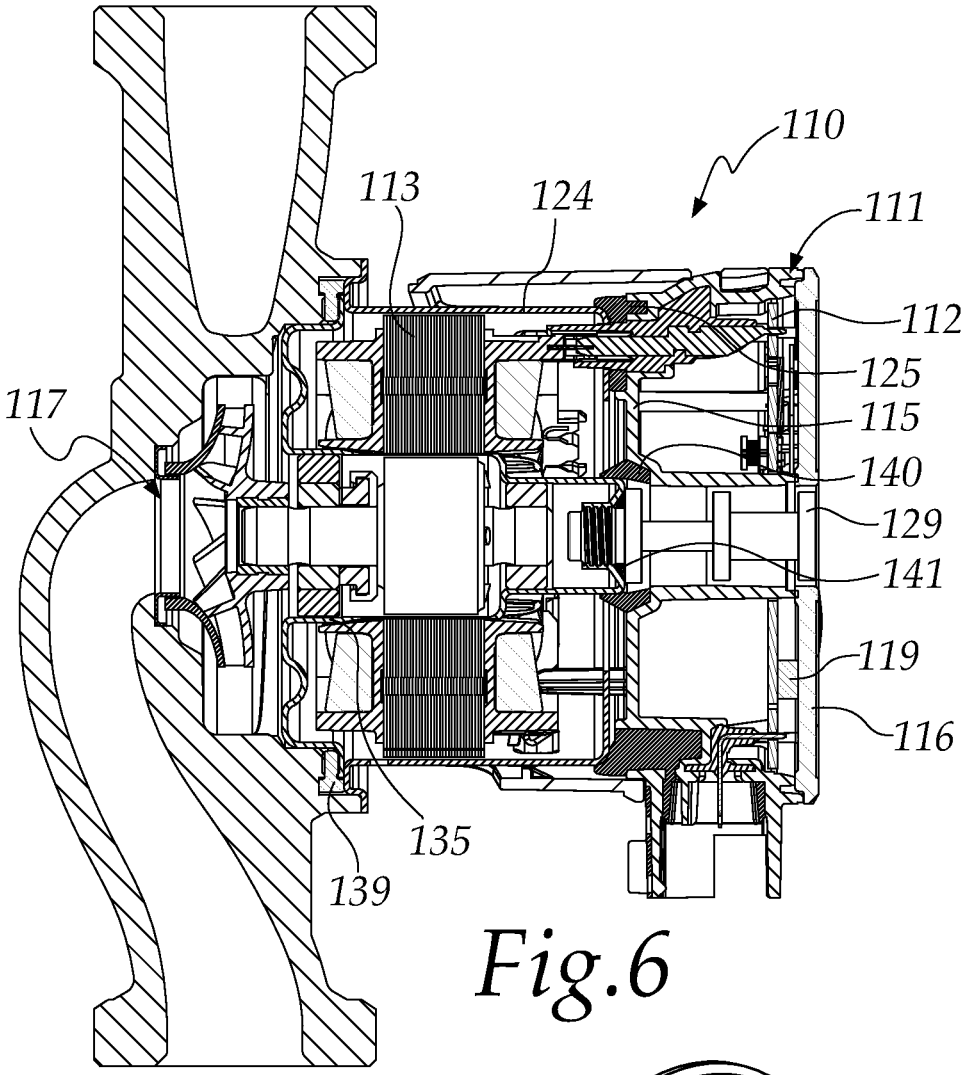
FIG. 6 is a sectional view of the electric pump assembly according to the disclosure in a second embodiment.
Figure 7:
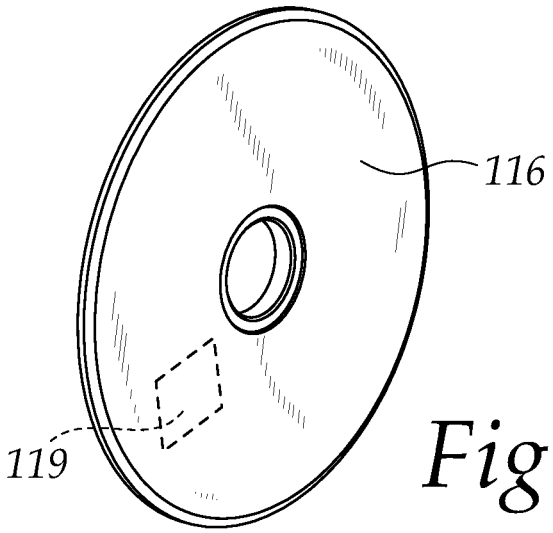
FIG. 7 is a general view of some components of the electric pump assembly of FIG. 6.

With reference to FIG. 6, an electric pump assembly according to the disclosure, in a different embodiment, is designated by the reference numeral 110.

Such centrifugal electric pump assembly 110 is provided in a manner similar to what has already been described in the preceding embodiment.

In this constructive variation, however, the box 111, constituted by a tray 115 which is closed hermetically with a lid 116, comprises a capacitive button 119 for interaction with the electronic board 112.

In particular, the capacitive button 119 is located between the lid 116 of the box 111 and the electronic board 112, which is contained therein.

In this case, the lid 116 of the box 111 is not provided with opening regions and therefore the box 111 is closed hermetically without the aid of an adhesive label.

FIG. 6 shows the lid 116 with a view on its face that is external to the box 111.

In this constructive variation, all the sealing elements described in the preceding embodiment are present.

In this variation there is no hole on the surface of the box 111 that faces the casing 124, since the box 111, which is closed hermetically, is capable of withstanding overpressures even up to 0.3 bar without being damaged and maintaining the seal, which is close to an IP68 level.

In the present description, the abbreviations "IP68" and "IPX5" reference the levels defined by the International Electrotechnical Commission (IEC).

It should be noted that the electric pump assembly 110 with the box 111, in the variation with the box 111 without holes and openings, substantially has an IP68 seal, which has been verified by means of experimental tests.

This seal is achieved by virtue of

- the presence, between the casing 124 and the box 111, of a first sealing element 125;
- the presence, between the air gap sleeve 135, the casing 124 and the wet section 117, of a second sealing element 139;
- the presence, between the air gap sleeve 135, the casing 124 and the box 111, of a third sealing element 140;
- the presence, between the air gap sleeve 135 and the plug 129, of a fourth sealing element 141;
- a hermetic closure between the tray 115 and the lid 116 of the box 111.

It should also be noted that the electric pump assembly in the variation with the box 11 provided with at least one hole 30 and an opening region 34 as described above substantially has an IPX5 seal, which has been verified by means of experimental tests.

This IPX5 seal is achieved by virtue of

- the presence, between the casing 24 and the box 11, of a first sealing element 25;
- the presence, between the air gap sleeve 35, the casing 24 and the wet section 17, of a second sealing element 39;
- the presence, between the air gap sleeve 35, the casing 24 and the box 11, of a third sealing element 40;
- the presence, between the air gap sleeve 35 and the plug 29, of a fourth sealing element 41;
- a hermetic closure between the tray 15 and the lid 16 of the box 11 and the adhesive label so as to close the opening region 34.

In practice it has been found that the disclosure achieves the intended aims and advantages, providing a centrifugal electric pump assembly, of the type comprising a stator accommodation casing and a box, containing an electronic board, which faces one end of said stator accommodation casing, characterized in that it comprises, between said casing and said box, a sealing element, and in that said box is constituted by a tray and a lid which are mutually sealed hermetically.

The disclosure thus conceived is susceptible of numerous modifications and variations, all of which are within the scope of the appended claims; all the details may furthermore be replaced with other technically equivalent elements.

In practice, the materials used, so long as they are compatible with the specific use, as well as the contingent shapes and dimensions, may be any according to the requirements and the state of the art.

What is claimed is:

1. A centrifugal electric pump assembly comprising in sequence:

- a wet section,
- an air gap sleeve, which contains a rotor of an electric motor and a casing which contains a stator of the electric motor,
- a box, which contains an electronic board and has a tubular body- for the insertion of a plug for access to said wet section, said casing being substantially concentric to said air gap sleeve, wherein said box is constituted by a tray which is closed hermetically by a lid, and wherein said box comprises a perimetral cavity, and a first seal that is perimetrally co-molded with said box, wherein said first seal is disposed between said casing and said box, wherein a portion of the first seal extends into the perimetral cavity.

2. The centrifugal electric pump assembly according to claim 1, wherein said tray and said lid are welded hermetically by laser welding.

3. The centrifugal electric pump assembly according to claim 1, further comprising:

a second seal disposed between said air gap sleeve, said casing and said wet section, a third seal disposed between said air gap sleeve, said casing and said box, and a fourth seal disposed between said air gap sleeve and said plug.

4. The centrifugal electric pump assembly according to claim 1, wherein on said lid there is a portion that is separated from the lid and is adapted to define a surface of a button for interaction with the electronic board.

5. The centrifugal electric pump assembly according to claim 4, wherein an adhesive label is applied to a surface of the lid that is opposite with respect to a surface arranged inside the box and has at least such dimensions as to close the opening region that is adjacent to the portion.

6. The centrifugal electric pump assembly according to claim 1, wherein said box has at least one through hole.

7. The centrifugal electric pump assembly according to claim 6, wherein said hole is located on a surface of said box that faces said casing, within a perimeter defined by said first seal.

8. The centrifugal electric pump assembly according to claim 1, wherein said box comprises a capacitive button for interaction with said electronic board.

9. The centrifugal electric pump assembly according to claim 1, wherein said casing is made of stainless steel.

10. The centrifugal electric pump assembly according to claim 1, wherein the first seal comprises a first material, the box comprises a second material, and wherein the first material is different from the second material.

11. The centrifugal electric pump assembly according to claim 1, wherein a region of the casing is configured to interface with the first seal.

12. The centrifugal electric pump assembly according to claim 11, wherein the region comprises a surface roughness.

13. The centrifugal electric pump assembly according to claim 12, wherein the surface roughness is configured to provide friction and adhesion with the first seal.

14. The centrifugal electric pump assembly according to claim 13, wherein said friction and adhesion is sufficient to avoid penetration of dust and/or water inside the motor.

* * * * *